US007249551B1

(12) United States Patent
Ray

(10) Patent No.: US 7,249,551 B1
(45) Date of Patent: Jul. 31, 2007

(54) GASKET CUTTER WITH CHANGEABLE AND REVERSIBLE DIES AND PUNCHES

(76) Inventor: Daniel W. Ray, 5400 Bellaire Blvd., Suite C, Bellaire, TX (US) 77401

( * ) Notice: Subject to any disclaimer, the term of this patent is extended or adjusted under 35 U.S.C. 154(b) by 337 days.

(21) Appl. No.: 10/943,124

(22) Filed: Sep. 17, 2004

(51) Int. Cl.
*B26F 1/02* (2006.01)
*B26F 1/14* (2006.01)

(52) U.S. Cl. ..... 83/631; 83/685; 83/686; 83/698.91; 83/955; 30/178; 30/229; 30/358

(58) Field of Classification Search ..... 83/55, 83/552, 627, 631, 635, 658, 684–690, 698.91, 83/955; 30/115, 130, 178, 182, 208, 229, 30/241, 272.1, 301, 302, 316, 358
See application file for complete search history.

(56) References Cited

U.S. PATENT DOCUMENTS 545,613 A * 9/1895 Richardson ..... 30/363
1,430,373 A * 9/1922 Hennings ..... 30/130
2,477,572 A * 8/1949 Blasak ..... 30/130
3,022,510 A * 2/1962 O'Malley ..... 227/78
4,548,113 A * 10/1985 Topperwien et al. ..... 83/345
4,817,287 A * 4/1989 Arnold et al. ..... 30/178
4,843,931 A * 7/1989 Whister ..... 83/138
5,429,573 A * 7/1995 Jahnke et al. ..... 483/1
6,823,764 B1 * 11/2004 Tsubota ..... 83/249

* cited by examiner

*Primary Examiner*—Clark F. Dexter

(57) ABSTRACT

A gasket cutter with changeable and reversible dies and punches including a body having upper and lower opposed arm members, a cylindrical member slidingly engaged within said upper arm member to be raised and lowered by rotation of a handle attached to the cylindrical member, and a platen releasably secured to the lower arm member. A cylindrical punch and a ring die surrounding the punch are attached to the platen. The ring die includes a first and second inner diameter at first and second ends thereof creating with said punch a first and second gap, respectively. A reversible punch die having first and second opposed cutting edges is releasably attached to the cylindrical member so that the first or second cutting edge of the punch die descends into the first or second gap, thereby cutting a ring gasket of a desired size from a sheet of gasket material.

16 Claims, 4 Drawing Sheets

GASKET CUTTER WITH CHANGEABLE AND REVERSIBLE DIES AND PUNCHES

BACKGROUND OF THE INVENTION

This version of the invention is concerned with the field of gasket cutters. More specifically, this version of the invention is concerned with a gasket cutter having changeable and reversible dies and punches so as to form gaskets with a variety of thicknesses and diameters.

1. Prior Art

A variety of tools and devices are available for creating gaskets from a sheet of gasket material. The means and methods of forming a gasket usually involve a multi-step process whereby a hole pattern is first formed in the gasket material. The gasket material is then removed from the tool or device after the pattern is formed, and the hole is then punched as indicated by the pattern. This process is time-consuming, laborious, and subject to errors. For instance, if the pattern and punching are not formed carefully, errors and misaligned or incorrectly-sized gaskets may be formed, resulting in a waste of time, effort, and gasket material.

This process becomes especially cumbersome when it is necessary to form gaskets having a variety of diameters and thicknesses as various patterns must first be formed with subsequent holes being punched to form the gaskets. Inevitably, this demand for gaskets of varying size only increases the chance for error and incorrectly sized gaskets.

What is needed then to overcome the aforementioned disadvantages of forming and creating gaskets is the provision of a portable gasket cutter employing a variety of changeable and reversible dies and punches in order to accurately create gaskets having an assortment of thicknesses and diameters, i.e. inner and outer diameters. The gasket cutter that is the subject of the instant invention is able to produce said gaskets by employing a series of punches, ring dies, and combination punch dies having cutting edges of varying size and diameter.

2. Discussion of the Prior Art

Numerous designs for gasket cutters and similar devices have been provided in the prior art. Even though these designs may be suitable for the specific individual purposes to which they address, they would not be suitable for the purposes of the present version of the invention as such designs are elaborate in design, cumbersome to use, and are limited in ability to create gaskets of varying size, thickness, and diameter. These designs are exemplified by U.S. Pat. No. 3,842,652, Screw Press, issued to Yonezawa et al. on 22 Oct. 1974; U.S. Pat. No. 4,782,730, Straddling Gasket Cutter, issued to Picone et al. on 8 Nov. 1988; U.S. Pat. No. 4,881,399, Double-Action Screw Press, issued to Bocharov et al. on 21 Nov. 1989; U.S. Pat. No. 5,136,905, Device And Method For Forming A Gasket Hole, issued to Stack et al. on 11 Aug. 1992; U.S. Pat. No. 5,230,237, Cutting And Flanging Tools, issued to Johansson on 27 Jul. 1993; U.S. Pat. No. 6,219,925, Punch Having Changeable Punching Member, issued to Chen on 24 Apr. 2001; and U.S. Pat. No. 6,286,216, Tool For Making Circular Cuts, issued to Braun on 11 Sep. 2001.

As such, it may be appreciated that there is a continuing need for a new and improved gasket cutter with changeable and reversible dies and punches, said punches, ring dies, and combination punch dies having cutting edges of varying size and diameter. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

The present version of the invention, which will be described in greater detail hereinafter, relates to the field of gasket cutters. More specifically, this version of the invention is concerned with a gasket cutter having changeable and reversible dies and punches so as to form gaskets with a variety of thicknesses and diameters. My version of the invention overcomes all of the shortcomings listed previously, in addition to novel aspects that will be described in detail hereinafter.

Described briefly, according to a typical embodiment, the invention presents a gasket cutter with changeable and reversible dies and punches. The gasket cutter is comprised of a body having a top arm member, side member, and bottom arm member. A neck is located on the top arm member and is surrounded by exterior screw threads and encloses a cylindrical bore that extends through said neck and corresponding portion of the top arm member. A threaded bore is located within one side of the top arm member at the end thereof and communicates with a portion of said cylindrical bore extending through said top arm member of the body. A threaded bore is located medially within the side member and receives therein the shank portion of a grasping handle. The bottom arm member of the body has a bore located at the end thereof directly under the cylindrical bore of the top arm member.

A cylindrical ram is disposed within the cylindrical bore. The ram is comprised in part of a longer threaded bore extending for most of the length of the ram, a shorter threaded bore communicating at a first end thereof with an internally-located end of the longer threaded bore, and a bore communicating with an opposed second end of the shorter threaded bore. A narrow, elongate groove is located on the exterior of the ram. When the ram is inserted into the cylindrical bore, the groove is aligned with the threaded bore of the top arm member, and a threaded fastener is inserted into said threaded bore so that the end of the threaded fastener extends into the groove. The threaded fastener, extending into the groove of the ram, prevents the ram from turning or rotating with respect to the cylindrical bore while it is being lowered or raised during use of the gasket cutter.

A ram drive screw is disposed within the ram and is comprised of first and second shank sections, an annular flange, and threaded shank. The threaded shank of the screw is inserted into the longer threaded bore of the ram and engages cooperating screw threads. A narrow groove is located on the exterior of the first shank section of the ram drive screw and receives a flat, semi-circular insert.

A ram retainer cap with internal screw threads is attached to the neck of the body by the internal screw threads thereof engaging the exterior screw threads of the neck. The first shank section of the ram drive screw extends through a bore of the cap when the cap is attached to the body as such. A disc-shaped handle is attached to the end of the ram drive screw extending beyond the cap by inserting the first shank section of the ram drive screw into a bore located centrally within the handle. A groove is located on the sidewall of the handle that surrounds the central bore thereof. The flat, semi-circular insert, which is disposed within the narrow groove of the first shank section of the ram drive screw, extends slightly beyond the first shank section of the ram drive screw to occupy the groove of the handle, thereby preventing the handle from rotating with respect to the ram drive screw during use of the gasket cutter. The handle is secured to the ram drive screw by a threaded fastener that is inserted into a spacer located over the central bore of the handle and then into a threaded bore located centrally within the first shank section of the ram drive screw.

A cylindrical die guide post with a central bore is fitted within the bore of the bottom arm member of the body. A flat, rectangular platen with a central aperture is placed over the post with the central aperture of the platen receiving the die guide post. A punch is fitted over the portion of the die guide post extending above the platen. The punch is attached to the die guide post and over the platen by a threaded fastener that is inserted through the bore of the bottom arm member, through the bore of the die guide post, and into a threaded bore of said punch, at which time screw threads of the fastener engage cooperating screw threads of the threaded bore. A ring die is positioned over the punch already secured on the platen and is secured to the platen by a pair of clamps, which are releasably attached to the platen on opposed sides of the ring die.

A punch die is attached by a threaded fastener to the bottom of the ram, said threaded fastener extending through a central bore of the punch and into the shorter threaded bore of the ram whereby screw threads of the fastener engage cooperating screw threads of the threaded bore.

As the handle is rotated in one direction, the ram drive screw urges the ram downward, pushing the punch die to the punch and the surrounding ring die. A sheet of gasket material is positioned over the punch and the ring die. The cutting edge of the punch die descends into a gap located between the cutting edge of the ring die and the cooperating edge of the punch, thereby cutting a gasket corresponding in size, thickness, and diameter of said gap. When gasket cutting is completed the punch and the ring die each can be reversed or replaced to cut a gasket of another size, thickness, and diameter.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

OBJECTS OF THE INVENTION

Accordingly, it is an object of my version of the invention to provide a low-cost, easy-to-manufacture, and easy-to-market gasket cutter with changeable and reversible dies and punches.

A further object of my version of the invention is to provide an easy-to-use and versatile gasket cutter with changeable and reversible dies and punches.

A significant object of the invention is to provide a gasket cutter with changeable and reversible dies and punches that is comprised of a body having a top arm member with a neck, said neck enclosing a cylindrical bore, a side member with a grasping handle releasably attached to said side member, and a bottom arm member enclosing a cylindrical bore; a ram drive screw and a ram, said ram drive screw attached in rotating engagement to the ram and both disposed within the cylindrical bore of the neck of said body; a handle attached to the ram drive screw so as to rotate said ram drive screw and lower or raise as necessary said ram with respect to a cylindrical bore of the neck of said body; a punch die attached to the bottom end of said ram; and a punch and a surrounding ring die attached to the bottom arm member of said body directly below the bottom end of said ram and said punch die attached thereon.

A final but very significant object of the invention is to provide a gasket cutter with changeable and reversible dies and punches so as to accurately create gaskets having an assortment of thicknesses and diameters, i.e. inner and outer diameters, with said punches, ring dies, and combination punch dies having cutting edges of varying size and diameter.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

10, 10' Gasket Cutter With Changeable And Reversible Dies And Punches
12 Body
14 Side Member
16 Top Arm Member
18 Bottom Arm Member
20 Neck
22 Screw Threads
24 Bore
26 Threaded Bore
28 Threaded Bore
30 Bore
32 Handle
34 Threaded Shank
36 Ram
38 Threaded Bore
40 Threaded Bore
42 Bore
44 Groove
46 Threaded Fastener
48 Ram Drive Screw
50 First Shank Section
52 Second Shank Section
54 Annular Flange
56 Threaded Shank
58 Threaded Bore
60 Groove
62 Bore
64 Insert
66 Washer
68 Ball Bearing Assembly Retainer
70 Ball Bearing Assembly
72 Ball Bearing Assembly Retainer
74 Ram Retainer Cap
76 Bore
78 Knurling
80 Handle
82 Depression
84 Bore
86 Groove
88 Scalloped Edge
90 Handle Retainer
92 Threaded Fastener
94 Die Guide Post
96 Upper Shank Section
98 Middle Shank Section
100 Lower Shank Section
102 Bore
104 Platen
106 Central Aperture
108 Side Apertures
110 Side Apertures
112 Punch
114 Bore
116 Threaded Bore
118 Threaded Fastener
120 Punch Retainer Fastener Spacer
122 Ring Die
124 Groove
126 Bore
128 Clamp
130 Slot
132 Lip
134 Threaded Fastener
136 Clamp
138 Slot
140 Lip
142 Threaded Fastener
144 Combination Punch die
146 Bore
148 Retainer
150 Bore
152 Threaded Fastener
154 Wider Section
156 Narrower Section
158 Cutting Edge
160 Cutting Edge
162 Cutting Edge
164 Gap
166 Cutting Edge
168 Gap
170 Gasket
172 Gasket
174 Body
176 Side Member
178 Side Member
180 Bottom arm member
182 Top arm member
184 Neck
186 Screw Threads
188 Bore
190 Threaded Bore
192 Threaded Bore

DESCRIPTION OF THE PREFERRED EMBODIMENT

A detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
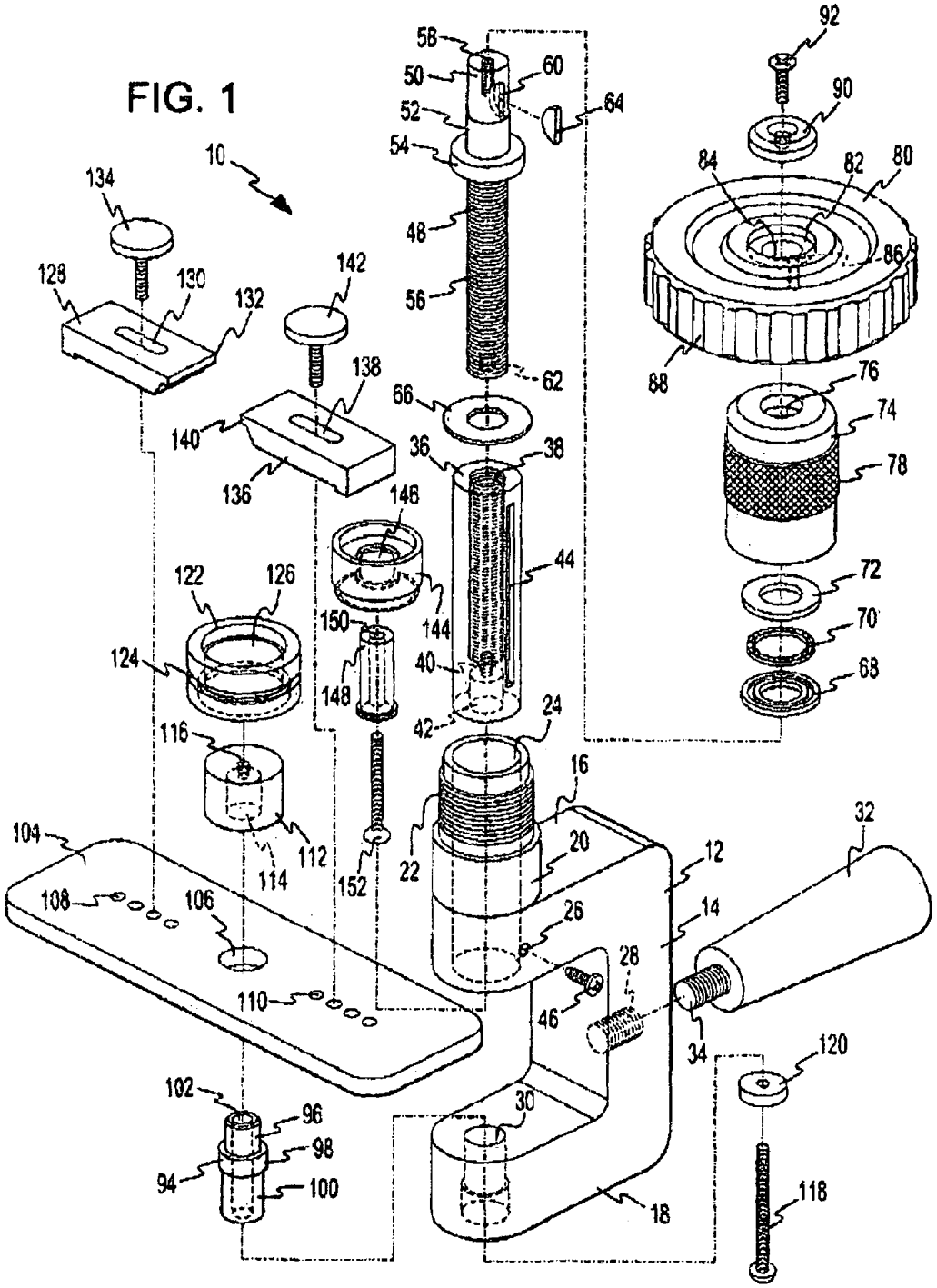
FIG. 1 is an exploded perspective view of a gasket cutter with changeable and reversible dies and punches in accordance with the present version of the invention illustrating the constituent components thereof.

Referring now to the drawings and, in particular, to FIG. 1 wherein there is illustrated a typical embodiment of the gasket cutter with changeable and reversible dies and punches 10. The present version of the invention 10 consists of a body 12 having a side member 14, top arm member 16, and opposed bottom arm member 18. The side member 14 is connected at a first end thereof to a first end of the top arm member 16 and at a second end thereof to a first end of the bottom arm member 18. The top 16 and bottom 18 arm members are disposed in parallel arrangement to each other and in perpendicular relation to the side member 14. As the top 16 and bottom 18 arm members are connected at first ends thereof to the side member 14, a space or opening is located between opposed second ends of the top 16 and bottom 18 arm members opposite to said connection of the top 16 and bottom 18 arm members to said side member 14. A cylindrical neck 20 is located on the top side and at the unconnected end of the top arm member 16. The neck 20 is comprised in part of exterior screw threads 22 and encloses a cylindrical bore 24 that extends through said neck 20 and cooperating portion of top arm member 16. A threaded bore 26 is located on a sidewall of the top arm member 16 and extends completely through the sidewall of said top arm member 16, communicating with said cylindrical bore 24 in perpendicular relation thereto. A threaded bore 28 (shown in phantom line) is located medially within the side member 14 of the body 12, and a bore 30 is located within the bottom arm member 18 directly under the cylindrical bore 24. A tapering, cylindrical handle 32 with threaded shank 34 is aligned for attachment to the side member 14 of the body 12. The handle 32 is releasably attached to the body 12 by inserting the threaded shank 34 thereof into the threaded bore 28 of the body 12.

An elongate, cylindrical ram 36 having first and second opposed ends is aligned above the bore 24 for insertion therein. The ram 36 is comprised in part of a first threaded bore 38 that extends along the longitudinal axis thereof, second threaded bore 40 communicating with an interior end of said first threaded bore 38, and a third bore 42 communicating with second threaded bore 40 at an end opposite to end of second threaded bore 40 communicating with first threaded bore 38. A narrow, elongate groove 44 is located on the exterior of the ram 36 and extends along the longitudinal axis thereof in parallel relation to the internal bores 38, 40, 42. When the ram 36 is inserted into the neck 20, the groove 44 is aligned with the threaded bore 26 of the top arm member 16 of the body 12. A threaded fastener 46 is inserted into the threaded bore 26 so that the end of the fastener 46 occupies a communicating portion of the groove 44, thereby preventing the ram 36 from turning within the bore 24 of the neck 20 as the cutter 10 is being used.

A ram drive screw 48 configured as a cylindrical rod with first and second opposed ends is located above the ram 36 for insertion into the first threaded bore 38 of the ram 36. The ram drive screw 48 is comprised of a first, narrower shank section 50, second wider shank section 52, annular flange 54, and a threaded shank 56 with left hand screw threads. The first 50 and second 52 shank sections present an unthreaded surface, machined smooth by metalworking techniques well known in prior art and design. The screw threads of the shank 56 communicate with screw threads of the first threaded bore 38 of the ram 36. A threaded bore 58 is located within the first, narrower shank section 50 of the ram drive screw 48, and an elongate groove 60 with a curved interior surface is located on the exterior of the narrower shank section 50 of the ram drive screw 48. The end of the threaded shank 56 of the ram drive screw 48 encloses a bore 62 (shown in phantom line). A flat, semi-circular insert 64 is aligned for insertion into the groove 60 of the first, narrower shank section 50 of the ram drive screw 48. A washer 66 is fitted over the threaded shank 56 and makes contact with the annular flange 54 when the ram drive screw 48 is attached to the ram 36, said attachment accomplished by inserting the threaded shank 56 of the ram drive screw 48 into the threaded bore 38 of said ram 36. A first ball bearing assembly retainer 68, ball bearing assembly 70, and second ball bearing assembly retainer 72 are fitted onto the ram drive screw 48 around the second, wider shank section 52 and upon the annular flange 54.

A cylindrical ram retainer cap 74 is comprised in part of a central bore 76 and exterior knurling 78. The cap 74 is fitted over the ram drive screw 48 when said screw 48 and ram 36 are attached to each other as described previously, and ram 36 is inserted within the cylindrical bore 24 of the body 12. The cap 74 contains internal screw threads (not shown) that engage cooperating screw threads 22 of the neck 20 when the cap 74 is screwed onto said neck 20. The first, narrower shank section 50 of the ram drive screw 48 extends above the top end of the cap 74 when said cap 74 is attached to said neck 20 as previously described.

A flat, disc-shaped handle 80 is located above the cap 74 and is comprised in part of a circular depression 82, central bore 84, narrow, elongate groove 86 (shown in phantom line) that communicates with and extends in parallel to central bore 84, and a scalloped, exterior edge 88. The handle 80 is attached to the ram drive screw 48 by placing the handle 80 over the first, narrower shank section 50 of the screw 48 extending above the cap 74 and aligning the bore 84 of the handle 80 with the first shank section 50 of the ram drive screw 48. The bore 84 receives the first shank section 50 with the insert 64 of the first shank section 50 and groove 86 of the bore 84 aligned so that said groove 86 can receive the portion of the insert 64 extending above and beyond the first shank section 50 of the ram drive screw 48 when said insert 64 is inserted into cooperating groove 60. The insert 64 received by said groove 60 ensures that the ram drive screw 48 turns in response to corresponding motion exerted by the handle 80. The handle 80 is secured to the first shank section 50 of the ram drive screw 48 by inserting a handle retainer 90 into the depression 82 and a threaded fastener 92 through a central aperture of the handle retainer 90, into the bore 84, and into threaded bore 58 of the first shank section 50.

A cylindrical die guide post 94 is aligned for insertion into the bore 30 of the bottom arm member 18 of the body 12. The die guide post 94 is comprised of a narrower upper shank section 96, middle shank section 98, and wider lower shank section 100. A bore 102 extends longitudinally through the interior of the post 94. The die guide post 94 is releasably attached to the bottom arm member 18 by inserting the lower shank section 100 thereof into the bore 30. The middle shank section 98 makes contact with the portion of the bottom arm member 18 surrounding the bore 30 so that the middle shank section 98 and upper shank section 96 extend above the surface of the bottom arm member 18 when the post 94 is inserted thereon.

A flat rectangular platen 104 is aligned for placement onto the bottom arm member 18 of the body 12. The platen 104 is comprised in part of a central aperture 106 and flanking series of apertures 108, 110. The platen 104, when situated upon the bottom arm member 18, is secured thereon by the middle shank section 98 of the die guide post 94 occupying the central aperture 106 of said platen 104.

A punch 112 is aligned over the platen 104 for attachment thereon. The punch 112 is comprised in part of an interior bore 114 and a threaded bore 116, which communicates with said interior bore 114. The punch 112 is secured to the platen 104 by inserting a threaded fastener 118 with spacer 120 into the bore 30 of the bottom arm member 18 of the body 12, through the bore 102 of the die guide post 94, through the bore 114 of the punch 112, and into the threaded bore 116. The screw threads of the threaded fastener 118 engage cooperating screw threads of the threaded bore 116 of the punch 112.

A ring die 122 is aligned over the punch 112 and is comprised in part of a groove 124 located medially on the exterior thereof and a central bore 126. The bore 126 of the ring die 122 receives the punch 112 when said ring die 122 is fitted over the punch 112.

A first clamp 128 is aligned over the platen 104 and is comprised in part of a central slot 130 and lip 132. A threaded fastener 134 is aligned over the slot 130 for insertion therein. A second clamp 136 is aligned over the platen 104 and is comprised in part of a central slot 138 and lip 140. A threaded fastener 142 is aligned over the slot 138 for insertion therein. The clamps 128, 136 secure the ring die 122 to the platen 104 over the punch 112 by positioning the clamps 128, 136 over corresponding apertures 108, 110 of the platen 104 and inserting threaded fasteners 134, 142, through respective slots 130, 138 and into respective apertures 108, 110. The clamps 128, 136 can be moved over the platen 104 until respective lips 132, 140 thereof are inserted into corresponding portions of the groove 124 of the ring die 122 at which point the threaded fasteners 134, 142 are fully tightened, thereby securing the clamps 128, 136 to the platen 104 and the ring die 122 to the platen 104 over the punch 112.

A punch die 144 with central bore 146 is aligned for attachment to the bottom of the ram 36 below the bore 24 of the neck 20 of the body 12. The punch die 144 is releasably attached to the ram 36 by inserting a cylindrical retainer 148 with central bore 150 into the bore 146 of the punch die 144 and then inserting a threaded fastener 152 into the bore 150 of the cylindrical retainer 148. The threaded fastener 152 extends into the bore 42 (shown in phantom line) of the ram 36 and engages cooperating screw threads of the threaded bore 40 (shown in phantom line) of said ram 36, thereby securing the retainer 148 within the punch die 144 and the punch die 144 to the ram 36. The threaded fastener 152 is secured to cooperating screw threads of the threaded bore 40 by inserting a screwdriver (not shown) through the bore 30 of the bottom arm member 18 of the body 12, so that the tip of the screwdriver engages and turns the head of the threaded fastener 152 as the screwdriver is rotated.

Figure 2:
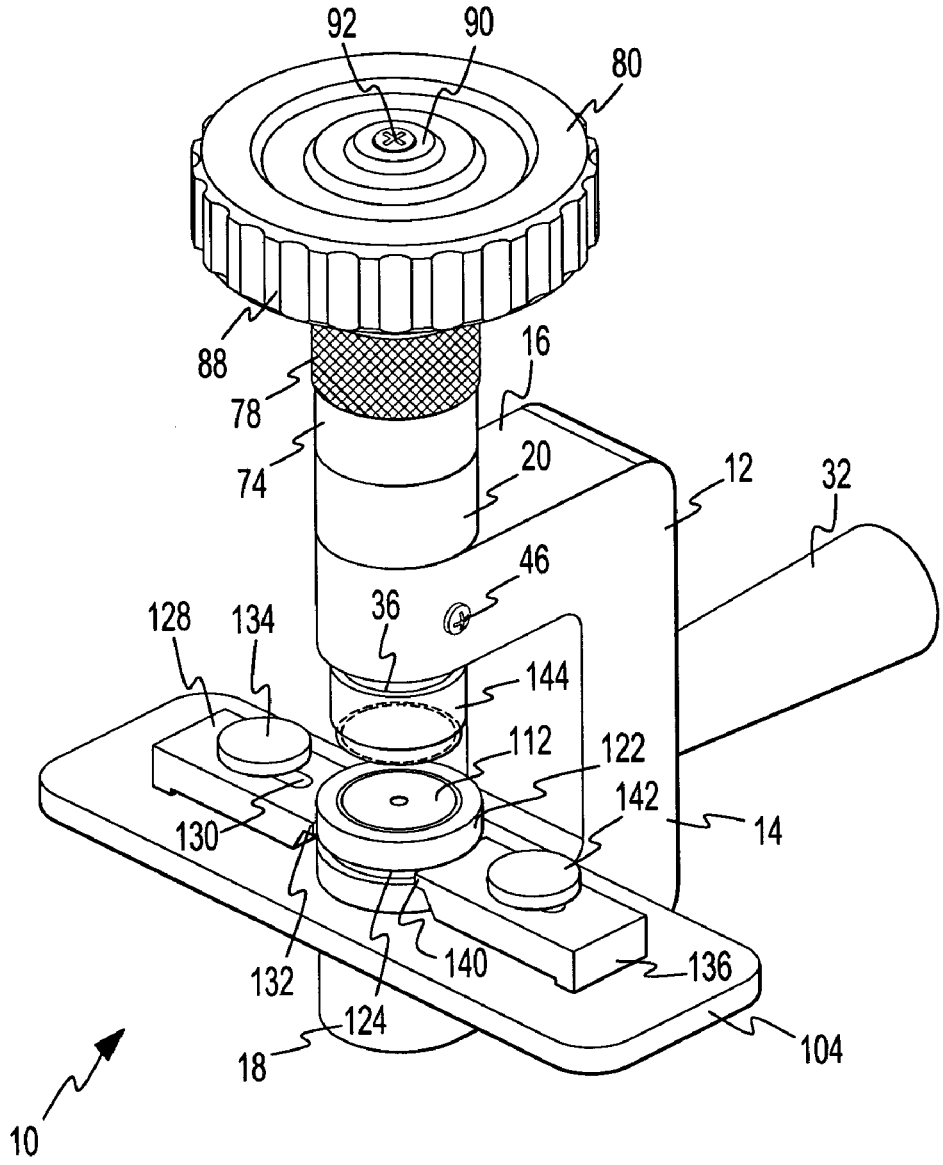
FIG. 2 is a perspective view of the gasket cutter with changeable and reversible dies and punches fully assembled with a first side of a ring die and combination punch die releasably attached thereon for cutting of a gasket of a particular diameter.

Referring to FIG. 2, therein illustrated is the gasket cutter with changeable and reversible dies and punches 10 fully assembled. The punch 112 is secured to the platen 104 as described previously and is surrounded by the ring die 122, which is secured to the platen 104 by opposed clamps 128, 136. Rotating the handle 80 causes the punch die 144 to be lowered to the punch 112 and ring die 122 to form a gasket in a manner that will be described later in this disclosure.

Figure 3:
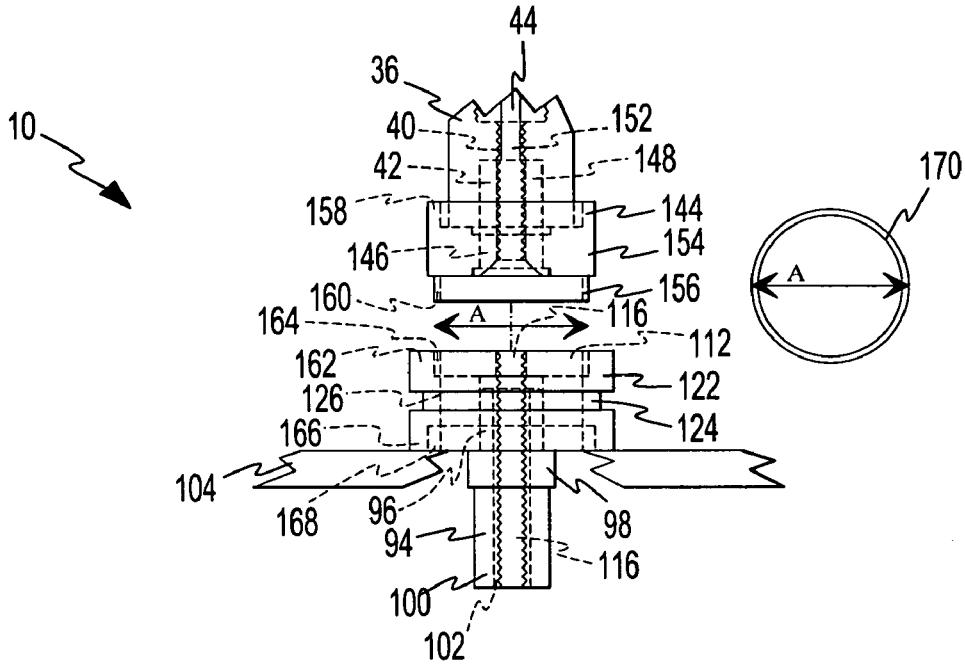
FIG. 3 is a partial elevation view of the gasket cutter with changeable and reversible dies and punches with a first side of a ring die and combination punch die releasably attached thereon for cutting of a gasket of a particular diameter.

In FIG. 3, therein is illustrated a fragmentary view of the gasket cutter with changeable and reversible dies and punches 10. The punch die 144 is attached to the bottom of the ram 36 as previously described, and the punch 112 and ring die 122 are attached to the platen 104 as previously described. The punch die 144 is comprised of a first section 154 having a wider diameter and a second section 156 having a narrower diameter. A first cutting edge 158 (shown in phantom line) is located at one end of the first section 154 of wider diameter, and a second cutting edge 160 (shown in phantom line) is located at one end of the second section 156 of narrower diameter. The first cutting edge 158 has an inside diameter of 0.7095 inches and an outside diameter of 0.835 inches. The second cutting edge 160 has an inside diameter of 0.7095 inches and an outside diameter of 0.772 inches. Thirty-seven punch dies are available in various increments up to a first cutting edge 158 having inside diameter of 1.4175 inches and an outside diameter of 1.543 inches and a second cutting edge 160 having an inside diameter of 1.4175 inches and an outside diameter of 1.480 inches.

The ring die 122 contains a first cutting edge 162 so that when said die 122 is placed over the punch 112 a gap 164 (shown in phantom line) is formed between inside diameter of said cutting edge 162 and corresponding edge of punch 112. A second cutting edge 166 is located on an opposed side of the ring die 122, and a gap 168 is formed between inside diameter said cutting edge 166 and corresponding edge of punch 112.

The first cutting edge 162 has an inside diameter of 0.7725 inches and an outside diameter of 1.024 inches. The second cutting edge 166 has an inside diameter of 0.8355 inches and an outside diameter of 1.024 inches. The bore 126 of the ring die 122 has a diameter of 0.7095 inches. Thirty-seven ring dies 122 are available in various increments up to a first cutting edge 162 having inside diameter of 1.4805 inches and an outside diameter of 1.732 inches and a second cutting edge 166 having an inside diameter of 1.5435 inches and an outside diameter of 1.732 inches. The bore 126 of the ring die 122 at this size has a diameter of 1.4175 inches. The punch 112 as illustrated has a diameter of 0.709 inches, and thirty-seven punches 112 are available in various increments up to a diameter of 1.417 inches.

A gasket is formed by placing a sheet of gasket material over the punch 112 and ring die 122 and lowering the punch die 144 onto the gasket material by rotating the handle 80 as described previously so that the cutting edge 160 of the punch die 144 occupies the gap 164 (shown in phantom line) located between the inside diameter of the cutting edge 162 of the ring die 122 and corresponding edge of the punch 112. A gasket 170 having an inner diameter of approximately 0.709 inches and outer diameter of 0.7725 inches as indicated by line A is thus formed.

Figure 4:
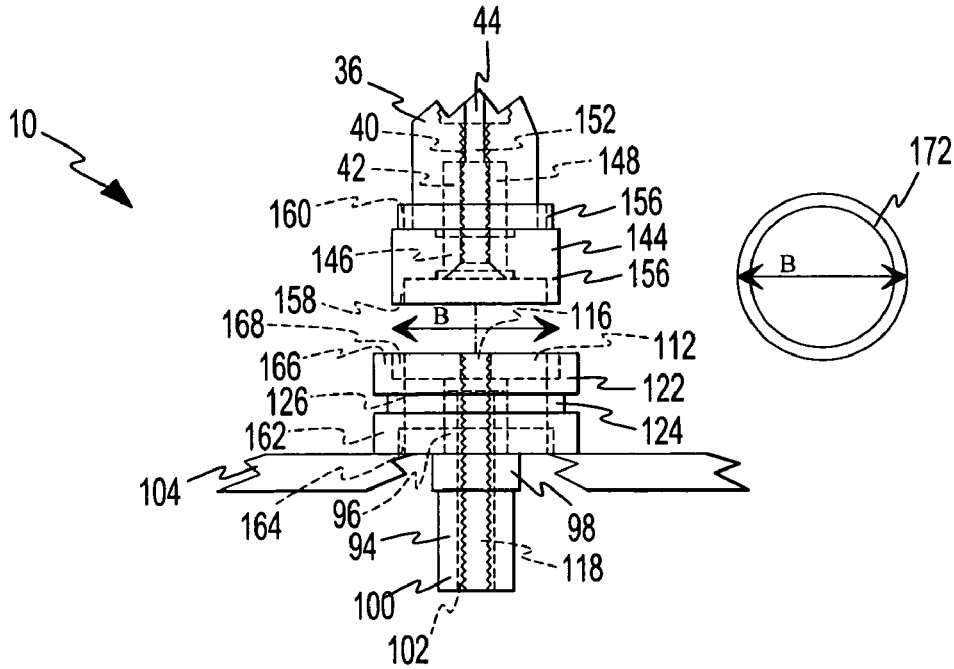
FIG. 4 is a partial elevation view of the gasket cutter with changeable and reversible dies and punches with a second, reverse side of a ring die and combination punch die releasably attached thereon for cutting of a gasket of a particular diameter.

In FIG. 4, the ring die 122 and punch die 144 are reversed so that cutting edge 158 of the punch die 144 occupies the gap 168 located between the inside diameter of the cutting edge 166 of the ring die 122 and corresponding edge of the punch 112. A gasket 172 having an inner diameter of approximately 0.709 inches and outer diameter of 0.8355 inches as indicated by line B is thus formed.

As such, a variety of cutting edges can be obtained by using a particular combination of a cooperating punch 112, ring die 122, and punch die 144 in order to punch out ring gaskets of various inner and outer diameters. Maximum flexibility is provided by being able to easily replace a particular punch 112, ring die 122, or punch 144 with another or by reversing the cutting edge of a particular ring die 122 already secured to the platen 104 or punch 144 already secured to the ram 38.

Figure 5:
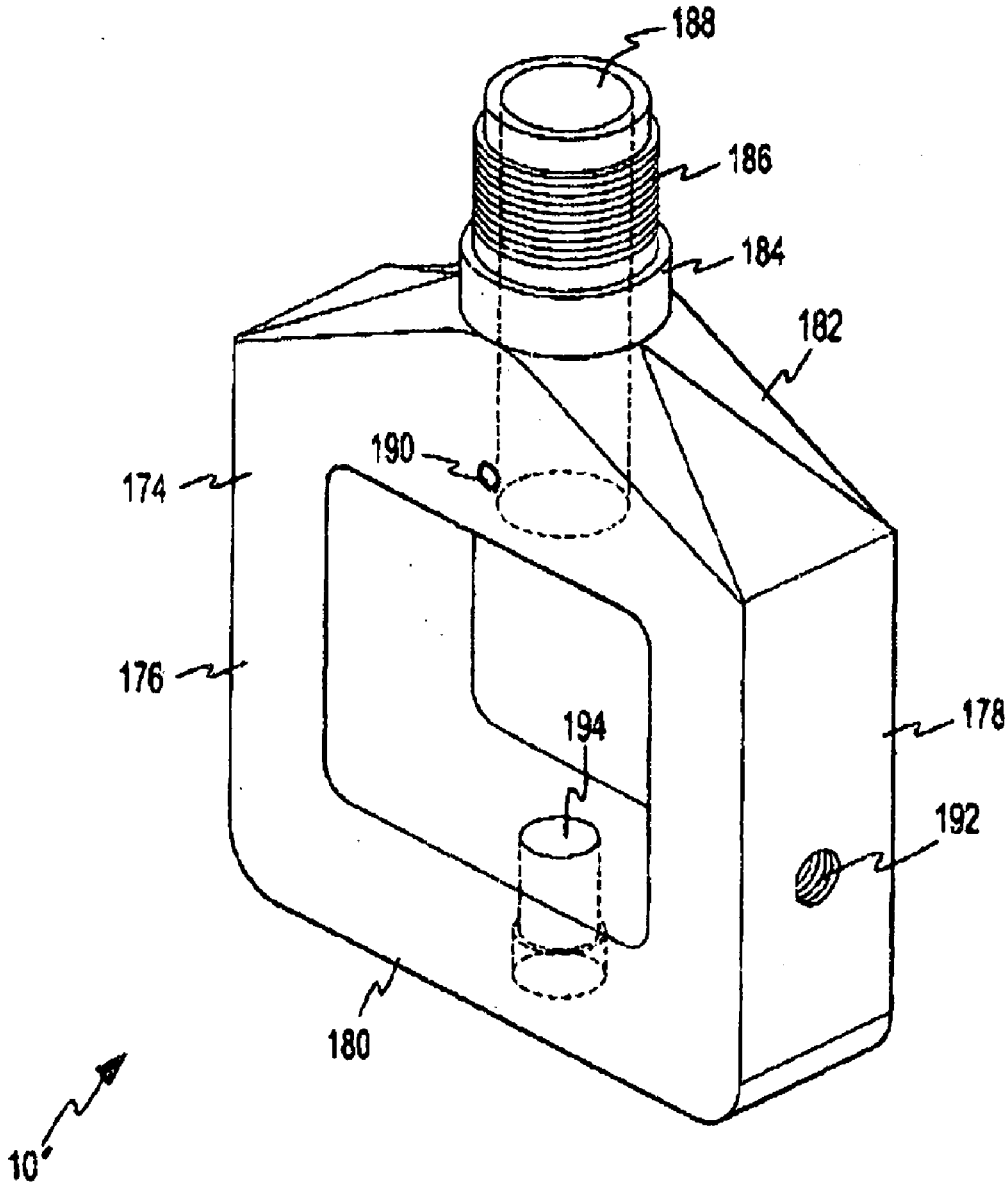
FIG. 5 is a perspective view of an alternate body of the gasket cutter with changeable and reversible dies and punches in accordance with the present version of the invention.

An alternate body 174 for the gasket cutter 10' is displayed in FIG. 5. The body 174 is comprised of first 176 and second 178 opposed side members disposed in parallel relation, bottom arm member 180, top arm member 182, and neck 184. The neck 184 is comprised in part of exterior screw threads 186, and a cylindrical bore 188 that extends through the neck 184 and top arm member 182. A threaded bore 190 is located in the top arm member 182 and extends through said top arm member 182 so as to communicate with the cylindrical bore 188. A threaded bore 192 is located medially within the second side member 178, and a bore 194 is located medially within the bottom arm member 180.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved gasket cutter with changeable and reversible dies and punches has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as defined by the appended claims.

What is claimed is:

1. A gasket cutter with changeable and reversible dies and punches comprising:

a body, an elongate cylindrical member disposed in sliding engagement within a portion of said body, means to lower and raise said cylindrical member within said portion of said body, a platen located on a portion of said body opposite to said portion of said body from which said cylindrical member is lowered and raised, a punch releasably secured to a medial portion of said platen, a ring die situated around said punch and releasably secured to said platen, wherein a first annular gap is formed between said ring die and said punch, a punch die releasably attached to an end of said cylindrical member and extending toward said platen, said punch die having a first annular cutting edge at one end corresponding to said first annular gap, and a second annular cutting edge at an opposite end, wherein said punch die is lowered such that said first annular cutting edge is inserted into said first annular gap thereby cutting a ring gasket from gasket material situated between said ring die and said punch die such that said punch and said ring die are on one side of said gasket material and said punch die is on the opposite side of said gasket material, said ring gasket having first inner and outer diameters, said ring die and said punch die configured to be reversed on said platen and said end of said cylindrical member, respectively, to present a second annular gap and said second annular cutting edge corresponding to said second annular gap to cut a ring gasket having second inner and outer diameters, whereby said gasket cutter is configured to accommodate cooperating punches, ring dies, and punch dies of various sizes so as to produce ring gaskets with a variety of inside and outside diameters.

2. The gasket cutter with changeable and reversible dies and punches according to claim 1, said ring die having first and second inner diameters at opposed ends of said ring die, respectively, forming with said punch said first and second annular gaps, and said punch die having said first annular cutting edge defined by first outer and inner diameters of said punch die and said second annular cutting edge defined by second outer and inner diameters of said punch die, said cutting edges located at opposed ends of said punch die.

3. The gasket cutter with changeable and reversible dies and punches according to claim 1, in which the body comprises:

a rectangular side member, a rectangular top arm member, and a rectangular bottom arm member, said top and bottom arm members disposed in parallel relation and connected in perpendicular relation at first ends thereof to opposed ends of said side member, said top and bottom arm members at unconnected second ends thereof opposite to said first ends connected to said side member defining an opening between the unconnected second ends thereof, a cylindrical neck with exterior screw threads and enclosing a bore, said neck extending for a distance above the unconnected second end of said top arm member, said bore of said cylindrical neck extending longitudinally through said neck and into the unconnected second end of said top arm member of the body, a threaded bore located within one side of the unconnected second end of the top arm member and extending therethrough in perpendicular relation to the bore extending through said cylindrical neck and the unconnected second end of said top arm member of the body, a threaded bore located medially within the side member, said threaded bore disposed in perpendicular relation to the longitudinal axis of said side member with the opening thereof aligned with the connected first ends of the top and bottom arm members, and a bore located within the unconnected second end of the bottom arm member, the center of diameter of said bore aligned with a center of diameter of the bore extending through said cylindrical neck and the unconnected second end of top arm member of said body.

4. The gasket cutter with changeable and reversible dies and punches according to claim 3, in which said elongate cylindrical member is defined by first and second opposed ends and an outer diameter commensurate with the diameter of the bore extending through said cylindrical neck and said unconnected second end of said rectangular top arm member of said body, said cylindrical member containing therein a first longitudinally extending threaded bore, a second longitudinally extending threaded bore, and a third longitudinally extending unthreaded bore, said second bore communicating at a first end thereof with the first threaded bore and at a second, opposed end thereof with the third bore, an elongate slot located on the exterior of said cylindrical member, said slot disposed in parallel with the longitudinal axes of said cylindrical member and said three communicating bores situated within said cylindrical member, said cylindrical member disposed in sliding engagement within said bore extending through said cylindrical neck and said unconnected second end of said elongate rectangular top arm member of said body and maintained in proper alignment therein by a threaded fastener extending through said threaded bore located within one side of the unconnected second end of said top arm member with one end of said threaded fastener extending into said elongate slot located on the exterior of said cylindrical member.

5. The gasket cutter with changeable and reversible dies and punches according to claim 4, in which said means to lower and raise said cylindrical member within said portion of said body comprises:

an elongate cylindrical rod partially covered with screw threads, a cylindrical cap having an aperture centrally located at one end thereof and enclosing a bore with screw threads surrounding said bore, and a disc-shaped handle, said cylindrical rod disposed partially within said first threaded bore of said cylindrical member, said cylindrical cap detachably secured to said cylindrical neck of said body with said screw threads surrounding said bore of said cylindrical cap engaging said screw threads of said cylindrical neck, and said handle releasably attached to an end of said cylindrical rod, the end of said cylindrical rod extending through said aperture of said cylindrical cap so that rotation of said handle, connected to said cylindrical rod, rotates said cylindrical rod within said cylindrical member with said screw threads of said cylindrical rod engaging the screw threads of said first threaded bore of said cylindrical member and lowering or raising said cylindrical member within said bore of said cylindrical neck and said unconnected second end of said top arm member of said body, said cylindrical member prevented from rotating within said bore of said cylindrical neck and said unconnected second end of said top arm member of said body by said threaded fastener extending through said threaded bore located within one side of the unconnected second end of said top arm member with one end of said threaded fastener extending into said elongate slot located on the exterior of said cylindrical member.

6. The gasket cutter with changeable and reversible dies and punches according to claim 5, in which said disc-shaped handle contains:

a bore centrally located therein, a depression at one end of said bore, and an elongate groove extending longitudinally along said bore.

7. The gasket cutter with changeable and reversible dies and punches according to claim 6, in which said elongate cylindrical rod has first and second opposed ends defining a first exterior section configured as smooth and unthreaded, and a second, adjoining exterior section configured as screw threads, an annular flange separating first unthreaded and the second threaded exterior sections, a threaded bore extending for a distance longitudinally within said first exterior section from an adjacent end thereof, an elongate groove with a curved interior surface located on the first exterior section and extending longitudinally along said cylindrical rod, a flat insert having a curved edge corresponding to the curved interior surface of said elongate groove, said insert located within said groove so that said curved edge of insert communicates with the curved interior surface of said groove with a portion of said insert extending slightly beyond first exterior section of said cylindrical rod, and a bore extending for a distance longitudinally within said second exterior section from an adjacent end thereof.

8. The gasket cutter with changeable and reversible dies and punches according to claim 7, in which said disc-shaped handle is detachably secured to said elongate cylindrical rod by a portion of first exterior section of said rod occupying said bore of said handle with a spacer having a central aperture situated within said depression at one end of said bore of said handle and a threaded fastener extending through said central aperture of said spacer and inserted into said threaded bore located within said first exterior section at an adjacent end thereof of said cylindrical rod, with said groove of first exterior section of said cylindrical rod aligned with said groove located along said bore of said handle so that said portion of said insert extending slightly beyond said first exterior section of said cylindrical rod when said insert is located within said groove of said cylindrical rod occupies said groove located along said bore of said disc-shaped handle, thereby ensuring that said cylindrical rod rotates within said cylindrical member when said cylindrical rod is rotated by said disc-shaped handle.

9. The gasket cutter with changeable and reversible dies and punches according to claim 3, in which said platen contains:

a central aperture, and first and second series of threaded apertures flanking said central aperture, said platen situated upon said bottom arm member of said body with said central aperture of said platen aligned with said bore located within the unconnected second end of said bottom arm member of said body, said platen retained in such position upon said bottom arm member by a cylindrical hollow guide post occupying said bore of said bottom arm member and said central aperture of said platen.

10. The gasket cutter with changeable and reversible dies and punches according to claim 9, in which said punch contains:

a threaded first bore extending partially therethrough and a second bore extending partially therethrough, said first and second bores communicating with each other.

11. The gasket cutter with changeable and reversible dies and punches according to claim 10, in which said punch is located on said platen over said central aperture thereof and detachably secured thereto by said cylindrical guide post occupying said bore of said bottom arm member, said central aperture of said platen, and said second bore of said punch, with a threaded fastener inserted through said bore of said bottom arm member, a centrally located bore extending longitudinally through said cylindrical guide post, said second bore of said punch, and into said threaded first bore of said punch, wherein screw threads of said threaded fastener engage screw threads of said threaded first bore of said punch.

12. The gasket cutter with changeable and reversible dies and punches according to claim 1, in which said ring die has a central bore extending therethrough, said ring die having first and second identical outer diameters at opposed ends thereof, a first lesser inner diameter at a first end commensurate with the first outer diameter, and a second greater inner diameter at a second end commensurate with the second outer diameter, said first lesser inner diameter and said second greater inner diameter creating said first and second annular gaps, respectively, in conjunction with an outer diameter of said punch when said ring die is detachably secured to said platen around said punch with one of said gaps facing away from said platen and able to receive therein a corresponding one of said cutting edges of said punch die.

13. The gasket cutter with changeable and reversible dies and punches according to claim 1, in which said platen contains a central aperture, and first and second series of threaded apertures flanking said central aperture, and wherein said ring die is releasably attached to said platen around said punch by first and second clamps detachably secured to said platen by a respective threaded fastener extending through a slot of each clamp and into a respective aperture of one of said first and second series of threaded apertures flanking said central aperture, each clamp having a lip extending from one side thereof for a distance and engaging a groove surrounding said ring die.

14. The gasket cutter with changeable and reversible dies and punches according to claim 1, in which said elongate cylindrical member is defined by first and second opposed ends and includes therein a first longitudinally extending threaded bore, a second longitudinally extending threaded bore, and a third longitudinally extending unthreaded bore, said second bore communicating at a first end thereof with the first threaded bore and at a second, opposed end thereof with the third bore, wherein said punch die is detachably secured to one of said ends of said cylindrical member above said platen by a cylindrical retainer with a central bore extending longitudinally therethrough, and by a threaded fastener, said retainer inserted through a central bore of the said punch die and into said third longitudinally extending unthreaded bore of said cylindrical member, and said threaded fastener inserted through said central bore of said cylindrical retainer, past the central bore of said punch die and said third longitudinally extending unthreaded bore of said cylindrical member, and into said second longitudinally extending threaded bore of said cylindrical member, wherein screw threads of said threaded fastener engage cooperating screw threads of said second threaded bore, thereby securing said punch die to said one end of said cylindrical member such that the punch die is situated above said platen, said punch and said ring die attached to said platen.

15. The gasket cutter with changeable and reversible dies and punches according to claim 1, in which said body has grasping means for holding the gasket cutter.

16. The gasket cutter with changeable and reversible dies and punches according to claim 15, in which the grasping means comprises:

a detachable handle, said handle tapering from a first wider end to an opposed second narrower end with a threaded shank extending a distance from said second narrower end, said threaded shank inserted into a threaded bore of said body to detachably secure said handle to said body.

* * * * *